US007373885B2

(12) United States Patent
Skinner

(10) Patent No.: US 7,373,885 B2
(45) Date of Patent: May 20, 2008

(54) DEVICE FOR VENTING A CONTAINER HOUSING AN ENERGETIC MATERIAL AND METHOD OF USING SAME

(75) Inventor: Anthony T. Skinner, Duncanville, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 131 days.

(21) Appl. No.: 11/261,184

(22) Filed: Oct. 28, 2005

(65) Prior Publication Data

US 2007/0095239 A1 May 3, 2007

(51) Int. Cl.
*F41A 17/16* (2006.01)
*F02K 9/38* (2006.01)

(52) U.S. Cl. ..... 102/481; 60/223

(58) Field of Classification Search ..... 102/374, 102/378, 481; 60/223, 253, 254
See application file for complete search history.

(56) References Cited

U.S. PATENT DOCUMENTS

| | | | | | |
|---|---|---|---|---|---|
| 3,295,324 | A * | 1/1967 | Conard et al. | ..... | 60/254 |
| 3,971,290 | A * | 7/1976 | Blain | ..... | 89/1.14 |
| 4,478,151 | A | 10/1984 | Vetter et al. | ..... | 102/481 |
| 4,530,269 | A * | 7/1985 | Rau et al. | ..... | 89/1.14 |
| 4,597,261 | A | 7/1986 | Dolan | ..... | 60/223 |
| 4,649,824 | A * | 3/1987 | Guay | ..... | 102/307 |
| 4,766,726 | A * | 8/1988 | Tackett et al. | ..... | 60/255 |
| 4,961,313 | A * | 10/1990 | Dolan | ..... | 60/223 |
| 5,044,154 | A * | 9/1991 | English et al. | ..... | 60/223 |
| 5,117,758 | A * | 6/1992 | Renzi | ..... | 102/378 |
| 5,129,326 | A | 7/1992 | Brogan | ..... | 102/481 |
| 5,166,468 | A * | 11/1992 | Atkeson | ..... | 102/207 |
| 5,206,456 | A * | 4/1993 | Pracchia et al. | ..... | 102/207 |
| 5,227,579 | A * | 7/1993 | Gibson et al. | ..... | 102/378 |
| 5,361,703 | A | 11/1994 | Braithwaite | ..... | 102/481 |
| 5,369,955 | A * | 12/1994 | VanName et al. | ..... | 60/253 |
| 5,372,071 | A * | 12/1994 | Richards et al. | ..... | 102/378 |
| 5,507,231 | A * | 4/1996 | Moore et al. | ..... | 102/374 |
| 5,585,596 | A * | 12/1996 | Richards et al. | ..... | 102/378 |
| 5,786,544 | A * | 7/1998 | Gill et al. | ..... | 102/481 |
| 5,898,123 | A * | 4/1999 | Fritz et al. | ..... | 102/378 |
| 6,148,729 | A * | 11/2000 | Smith et al. | ..... | 102/307 |
| 6,363,855 | B1 | 4/2002 | Kim et al. | ..... | 102/481 |
| 6,952,995 | B2 * | 10/2005 | Friedlander, III | ..... | 102/481 |
| 7,051,511 | B2 * | 5/2006 | Prytz | ..... | 60/223 |
| 2003/0010246 | A1 * | 1/2003 | Bonnel et al. | ..... | 102/481 |
| 2004/0244358 | A1 * | 12/2004 | Prytz | ..... | 60/223 |
| 2005/0193917 | A1 * | 9/2005 | Friedlander, III | ..... | 102/481 |

* cited by examiner

*Primary Examiner*—Bret Hayes
(74) *Attorney, Agent, or Firm*—Daren C. Davis; James E. Walton

(57) ABSTRACT

A device for venting a container housing an energetic material includes an insulating portion, a charge holder disposed in the insulating portion, and an explosive cutting charge disposed in the charge holder. The device further includes a thermally activated initiation device, and a transfer line coupling the thermally activated initiation device and the explosive cutting charge. An apparatus includes a container, an energetic material disposed within the container, and a device, disposed within the container, for venting the container. The device for venting the container includes an insulating portion, a charge holder disposed in the insulating portion, and an explosive cutting charge disposed in the charge holder. The device for venting the container further includes a thermally activated initiation device, and a transfer line coupling the thermally activated initiation device and the explosive cutting charge.

18 Claims, 3 Drawing Sheets

DEVICE FOR VENTING A CONTAINER HOUSING AN ENERGETIC MATERIAL AND METHOD OF USING SAME

BACKGROUND

1. Field of the Invention

This invention relates to the venting of containers housing energetic materials. In particular, the invention relates to a device for venting a container housing an energetic material and a method of using the device.

2. Description of Related Art

Energetic materials, such as explosives and propellants, are often found in confined spaces, for example, within munitions. Under normal conditions, these materials are unlikely to explode or burn spontaneously; however, many are sensitive to heat. For example, when exposed to extreme heat (as from a fire), the energetic materials may be initiated, causing the munitions, in which the energetic materials are disposed, to inadvertently explode. Efforts have been made to develop "insensitive munitions," which are munitions that are generally incapable of detonation except in their intended missions to destroy a target. In other words, if the munition is exposed to elevated temperatures, such as from a fire, the munition will likely only burn, rather than explode.

One way that munitions have been made more insensitive is by developing new explosives and propellants that are less likely to be initiated by elevated temperatures. Such materials, however, are typically less energetic and, thus, may be less capable of performing their intended task. For example, a less energetic explosive may be less capable of destroying a desired target than a more energetic explosive. As another example, a less energetic propellant may produce less thrust than a more energetic propellant, thus reducing the speed and/or the range of the munition. Additionally, the cost to verify and/or qualify new explosives and/or propellants, from inception through arena-level and system-level testing, can be substantial when compared to improving the insensitive munition compliance of existing explosives and/or propellants.

While there are many ways known in the art to render devices containing energetic materials more insensitive to inadvertent activation, considerable room for improvement remains.

SUMMARY OF THE INVENTION

There is a need for an improved way of rendering devices containing energetic materials more insensitive to inadvertent detonation and/or deflagration.

Therefore, it is an object of the present invention to provide a device for venting a container housing an energetic material and a method of using the device.

In one aspect, the present invention provides a device for venting a container housing an energetic material. The device includes an insulating portion, a charge holder disposed in the insulating portion, and an explosive cutting charge disposed in the charge holder. The device further includes a thermally activated initiation device and a transfer line coupling the thermally activated initiation device and the explosive cutting charge.

In another aspect, the present invention provides an apparatus, including a container, an energetic material disposed within the container, and a device that is disposed within the container for venting the container. The device for venting the container includes an insulating portion, a charge holder disposed in the insulating portion, and an explosive cutting charge disposed in the charge holder. The device for venting the container further includes a thermally activated initiation device and a transfer line coupling the thermally activated initiation device and the explosive cutting charge.

In yet another aspect of the present invention, a method for venting a container housing an energetic material is provided. The method includes providing a thermally initiated venting device embedded in the energetic material, activating the thermally initiated venting device, and perforating the container.

The present invention provides significant advantages, including: (1) providing a means for venting a container housing an energetic material without activating the energetic material; (2) providing a means for venting a container housing an energetic material without adding significant weight to the container; and (3) providing a means for desensitizing an apparatus containing an energetic material to inadvertent initiation due to elevated temperatures without decreasing the energetic properties of the energetic material.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
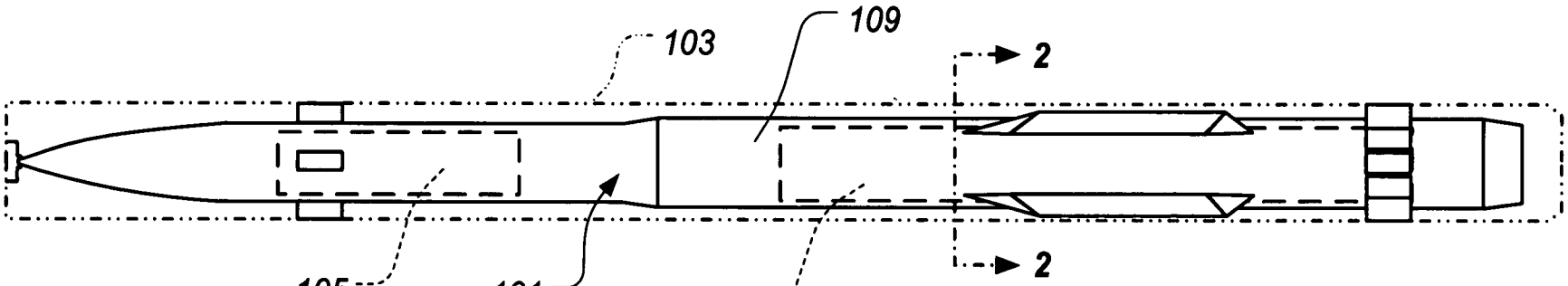
FIG. 1 is a side, elevational view of an illustrative embodiment of a munition according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to an apparatus for selectively venting a container in which an energetic material is disposed at a predetermined temperature or within a predetermined range of temperatures. For the purpose of this disclosure, an energetic material is defined as a material that, when subjected to a given amount of stimulating energy, reacts by producing a great deal more energy. Such materials, when confined within a container, may explode when heated. Examples of such energetic materials are propellants, explosives, pyrotechnic materials, and detonation initiation substances, although this list is neither exclusive nor exhaustive. The present invention seeks to inhibit inadvertent detonation or deflagration of confined energetic material as a result of heating by venting the container in which the energetic material is contained.

Many devices and systems incorporate energetic materials. Examples of such devices include, but are not limited to, munitions (e.g., missiles, rockets, bombs, and ballistic rounds), oilfield explosives (e.g., downhole perforating charges), airbags (e.g., automobile airbags), and containerized liquid or gelled explosives (e.g., those used in underground and underwater mining and/or demolition). The present invention is described below in relation to a propellant of a munition; however, the present invention is not so limited. Rather, the scope of the present invention encompasses its use in conjunction with various devices and systems that incorporate energetic material, such as those listed above. Note that this list is exemplary, and is neither exhaustive nor exclusive.

FIG. 1 provides a stylized, side, elevational view of a munition 101 contained within a canister 103 (shown in phantom). Such canisters may be used, for example, to protect munition 101 during shipment or to house munition 101 prior to launch. The type of canister 103, however, is immaterial to the practice of the present invention. Disposed within the illustrated munition 101 are energetic materials, specifically an explosive 105 and a propellant 107. The shapes, forms, and locations of energetic materials 105, 107 illustrated in FIG. 1 are merely exemplary. Energetic materials 105, 107 may take on any number of shapes or forms and be disposed at various locations within munition 101, depending upon the design of munition 101.

As described in more detail below, the present invention selectively vents munition 101 proximate explosive 105 and/or propellant 107 at a predetermined temperature or within a predetermined range of temperatures. The venting relieves pressure within munition 101, induced by heating, to inhibit inadvertent detonation of explosive 105 and/or propellant 107.

Figure 2:
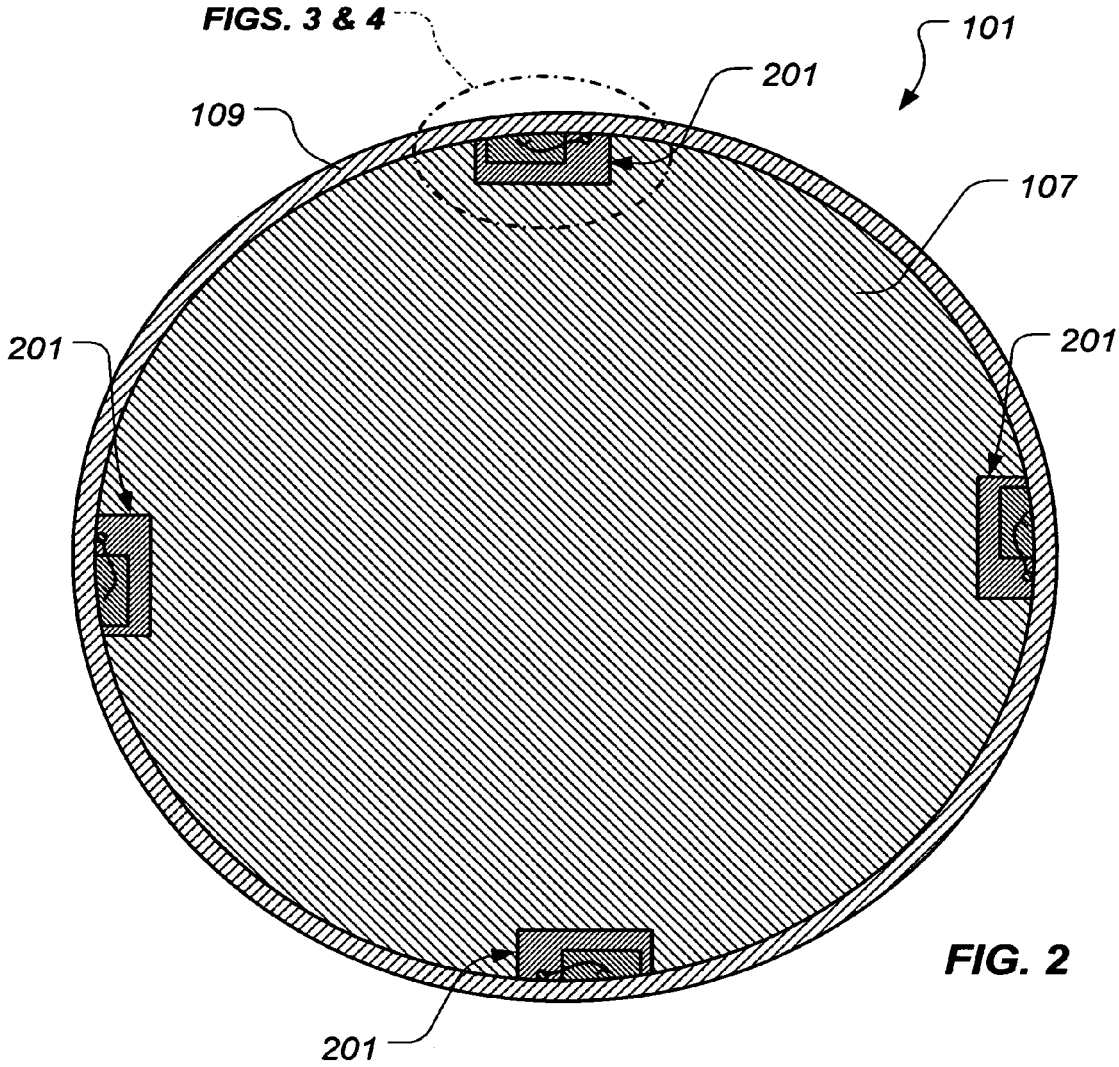
FIG. 2 is a cross-sectional view of the munition of FIG. 1 taken along the line 2-2 in FIG. 1.

FIG. 2 provides a cross-sectional view of munition 101 taken along a line 2-2 in FIG. 1. Munition 101 comprises a case 109 housing propellant 107. Note that structures, layers, and the like may exist between case 109 and propellant 107 even though no such structures are illustrated in FIG. 2. In the illustrated embodiment, a plurality of thermally initiated venting devices 201 is embedded in propellant 107. While FIG. 2 illustrates munition 101 comprising a plurality of thermally initiated venting devices 201, the scope of the present invention is not so limited. Rather, munition 101 may comprise only one thermally initiated venting device 201 or many thermally initiated venting devices 201. Moreover, munition 101 may include other venting devices in addition to thermally initiated venting device 201 that are operated in concert with or separately from thermally initiated venting device 201.

Figure 3:
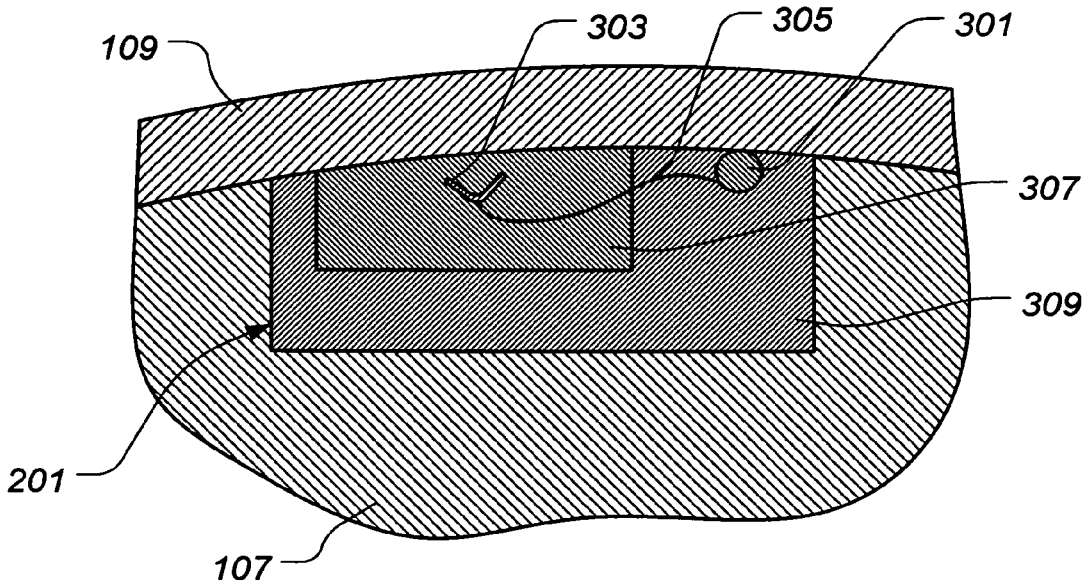
FIG. 3 is an enlarged, cross-sectional view of a portion of the munition of FIG. 1, including a first illustrative embodiment of a thermally initiated venting device, as indicated in FIG. 2.

FIG. 3 provides an enlarged view of one thermally initiated venting device 201 of FIG. 2. Thermally initiated venting device 201 comprises a thermally activated initiation device 301 coupled with an explosive cutting charge 303 by a transfer line 305. Explosive cutting charge 303 is disposed in a charge holder 307. Preferably, charge holder 307 is disposed in an insulating portion 309, and insulating portion 309 is embedded in propellant 107. Generally, thermally activated initiation device 301 deflagrates when subjected to a temperature at or above a predetermined temperature. Heat produced by deflagration of thermally activated initiation device 301 initiates deflagration in transfer line 305, which, in turn, detonates explosive cutting charge 303. Upon detonation, explosive cutting charge 303 perforates case 109 to relieve pressure or to avoid a build-up of pressure within case 109.

For the purposes of this disclosure, the term "deflagrate" means "to explosively react, such that the explosive reaction rate is less than the speed of sound in the reacting material." Deflagration differs from burning in that, during deflagration, the reacting material itself supplies oxygen required for the reaction. In burning, oxygen is supplied from another source, such as from the atmosphere. The term "detonate" means, for the purposes of this disclosure, "to explosively react, such that the explosive reaction rate is greater than about the speed of sound in the reacting material."

In the illustrated embodiment, thermally activated initiation device 301 comprises a thermally activated deflagrating charge. A deflagrating charge is a charge that explosively reacts, such that the explosive reaction rate is less than the speed of sound in the charge. Preferably, thermally activated initiation device 301 comprises a combination of rapid deflagrating material and a material that, as it reacts, exhibits an increasing reaction rate, causing the reaction to propagate until the material is consumed. Examples of such combinations include, but are not limited to, cesium dodecaborane/boron potassium nitrate ($Cs_2B_{12}H_{12}/BKNO_3$), lead azide, hexanitrostilbene (HNS), and ammonium perchlorate.

Preferably, thermally activated initiation device 301 is inactive at or below a predetermined propellant safety temperature and is activated above the propellant safety temperature. The particular temperature at which thermally activated initiation device 301 is activated is implementation specific, depending, at least in part, upon the particular material used as propellant 107. A material is chosen for thermally activated initiation device 301 that will spontaneously activate at or above the propellant safety temperature or within a range of temperatures at or above the propellant safety temperature. The propellant safety temperature is a temperature below the temperature at which propellant 107 will spontaneously ignite and explode (i.e., the "propellant auto-ignition temperature").

For example, if the auto-ignition temperature of propellant 107 is about 132° C., the propellant safety temperature may be about 93° C. Thus, in this example, thermally activated initiation device 301 is activated at a temperature above about 93° C. Alternatively, thermally activated initiation device 301 may activate within a range of temperatures, e.g., between the propellant safety temperature and a temperature between the propellant safety temperature and the propellant auto-ignition temperature. For example, in such an embodiment, thermally activated initiation device 301 activates between about 93° C. and about 121° C.

Figure 4:
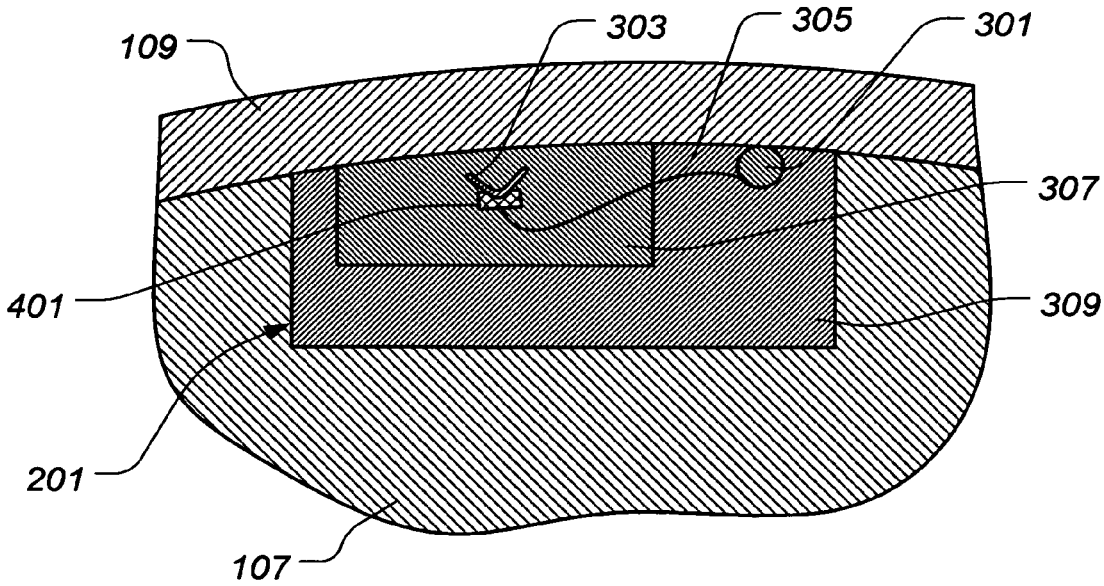
FIG. 4 is an enlarged, cross-sectional view of a portion of the munition of FIG. 1, including a second illustrative embodiment of a thermally initiated venting device, as indicated in FIG. 2.

Still referring to FIG. 3, transfer line 305 comprises a rapid deflagrating cord in one embodiment. The particular construction of transfer line 305 is implementation specific, depending, at least in part, upon the construction of explosive cutting charge 303. If, for example, the energy produced by an activated rapid deflagrating cord is insufficient to initiate explosive cutting charge 303, a booster 401 may be provided between transfer line 305 and explosive cutting charge 303, as illustrated in FIG. 4. Booster 401 amplifies the energy produced by activated transfer line 305 to a level sufficient to initiate explosive cutting charge 303. In one embodiment, booster 401 comprises a deflagration-to-detonation transition charge, which may comprise materials such as, for example, cesium dodecaborane/boron potassium nitrate, lead azide, HNS, and ammonium perchlorate. Note that the configuration of booster 401 provided in FIG. 4 is merely exemplary. Other configurations of booster 401 are encompassed by the scope of the present invention. For example, booster 401 may be spaced apart from explosive cutting charge 303 and coupled with explosive cutting charge 303 by a second transfer line capable of producing sufficient energy to detonate explosive cutting charge 303.

Explosive cutting charge 303 preferably comprises a linear shaped charge, as illustrated in FIGS. 3 and 4. As used herein, the term "linear shaped charge" includes elongated shaped charges that have straight or curved forms and that are flexible or rigid. One or more explosive cutting charges 303 may extend substantially along an entire dimension of propellant 107 or only along a portion of propellant 107. While FIGS. 3 and 4 illustrated explosive cutting charge 303 extending along a length of propellant 107, the scope of the present invention is not so limited. Rather, explosive cutting charge 303 may extend generally circumferentially about propellant 107, in a helical fashion about propellant 107, or in any other suitable geometric form about propellant 107. Moreover, the scope of the present invention encompasses forms of explosive cutting charge 303 other than a linear shaped charge.

Figure 5:
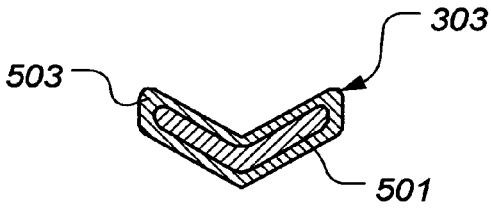
FIG. 5 is an enlarged, cross-sectional view of an illustrative embodiment of an explosive cutting charge of FIGS. 3 and 4.

In one particular embodiment, illustrated in FIG. 5, explosive cutting charge 303 is a linear shaped charge, comprising an explosive material 501 enveloped by a copper sheath 503. In one embodiment, explosive material 501 comprises a plastic bonded explosive, such as PBXN-5 explosive with a "coreload" of about 50 grains per foot. The term "coreload", as it is used herein, means the weight of explosive material in grains per foot of length. Other explosive materials and sheath materials, however, are encompassed within the scope of the present invention.

Referring again to FIGS. 3 and 4, explosive cutting charge 303 is disposed in charge holder 307, such that, when detonated, explosive cutting charge 303 perforates case 109. Preferably, charge holder 307 comprises a shock absorbing material, such as a foam, to isolate propellant 107 from a mechanical shock resulting from detonation of explosive cutting charge 303. In the illustrated embodiment, charge holder 307 is disposed in insulating portion 309, which insulates propellant 107 from heat generated by thermally activated initiation device 301, explosive cutting charge 303, and/or transfer line 305.

In the illustrated embodiment, thermally activated initiation device 301 is disposed in insulating portion 309 and transfer line 305 extends from thermally activated initiation device 301, through parts of insulating portion 309 and charge holder 307, to explosive cutting charge 303. The scope of the present invention, however, is not so limited. Rather, thermally activated initiation device 301 may be disposed remotely from other elements of thermally initiated venting device 201 or may be disposed in charge holder 307, such that propellant 107 is protected from heat generated by thermally initiated venting device 201 when activated. Moreover, in the embodiments of FIGS. 3 and 4, thermally activated initiation device 301 is immediately adjacent to case 109. The scope of the present invention however, encompasses embodiments wherein thermally activated initiation device 301 is spaced away from case 109 but still is responsive to excessive temperatures encountered by munition 101.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A device for venting a container housing an energetic material, comprising:

an insulating portion;

a charge holder disposed in the insulating portion;

an explosive cutting charge disposed in the charge holder;

a thermally activated initiation device comprising a deflagrating charge; and a transfer line coupling the thermally activated initiation device and the explosive cutting charge.

2. The device, according to claim 1, wherein the thermally activated initiation device is disposed in the insulating portion.

3. The device, according to claim 1, wherein the charge holder comprises:

a shock absorbing material.

4. The device, according to claim 1, wherein the explosive cutting charge is a linear shaped charge.

5. The device, according to claim 1, wherein the transfer line comprises:

a rapid deflagrating cord.

6. The device, according to claim 1, further comprising a booster disposed in-line with the transfer line between the thermally activated initiation device and the explosive cutting charge.

7. The device, according to claim 1, wherein the device is adapted to be embedded in the energetic material.

8. The device, according to claim 1, wherein the device is adapted to be disposed within the container.

9. The device, according to claim 1, wherein the thermally activated initiation device is activated at a temperature below an activation temperature of the energetic material.

10. An apparatus, comprising:

a container;

an energetic material disposed within the container; and a device that is disposed within the container for venting the container, comprising:

an insulating portion;

a charge holder disposed in the insulating portion;

an explosive cutting charge disposed in the charge holder;

a thermally activated initiation device comprising a deflagrating charge; and a transfer line coupling the thermally activated initiation device and the explosive cutting charge.

11. The apparatus, according to claim 10, wherein the insulating portion is embedded in the energetic material.

12. The apparatus, according to claim 10, wherein the thermally activated initiation device is disposed in the insulating portion.

13. The apparatus, according to claim 10, wherein the charge holder comprises:

a shock absorbing material.

14. The apparatus, according to claim 10, wherein the explosive cutting charge is a linear shaped charge.

15. The apparatus, according to claim 10, wherein the transfer line comprises:

a rapid deflagrating cord.

16. The apparatus, according to claim 10, further comprising a booster disposed in-line with the transfer line between the thermally activated initiation device and the explosive cutting charge.

17. The apparatus, according to claim 10, wherein the container is a munition case.

18. The apparatus, according to claim 10, wherein the thermally activated initiation device is activated at a temperature below an activation temperature of the energetic material.

* * * * *

UNITED STATES PATENT AND TRADEMARK OFFICE
Certificate

Patent No. 7,373,885 B2 Patented: May 20, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Anthony T. Skinner, Duncanville, TX (US); and Michael L. Fortner, Bedford, TX (US).

Signed and Sealed this Eleventh Day of October 2011.

MICHAEL J. CARONE
*Supervisory Patent Examiner*
Art Unit 3641
Technology Center 3600